US006347475B1

(12) United States Patent
Trostel

(10) Patent No.: US 6,347,475 B1
(45) Date of Patent: Feb. 19, 2002

(54) ARM ATTACHABLE DEVICE FOR CATCHING SPENT SHELLS

(76) Inventor: Thad Trostel, P.O. Box 362, Arendtsville, PA (US) 17303

( * ) Notice: Subject to any disclaimer, the term of this patent is extended or adjusted under 35 U.S.C. 154(b) by 0 days.

(21) Appl. No.: 09/771,422

(22) Filed: Jan. 26, 2001

(51) Int. Cl.[7] ..... F41A 15/00
(52) U.S. Cl. ..... 42/98; D22/108
(58) Field of Search ..... 42/98, 90, 106; D22/108

(56) References Cited

U.S. PATENT DOCUMENTS 4,296,565 A * 10/1981 Jaffin et al. ..... 42/98
4,334,375 A * 6/1982 Olson ..... 42/98
D297,346 S * 8/1988 MacKenzie et al. ..... 42/98
4,959,918 A * 10/1990 Perez ..... 42/98

FOREIGN PATENT DOCUMENTS

GB 1336696 * 11/1973

* cited by examiner

*Primary Examiner*—J. Woodrow Eldred
(74) *Attorney, Agent, or Firm*—Goldstein Law Offices, P.C.

(57) ABSTRACT

An arm attachable device for catching spent shells including an arm brace adapted for positioning on a forearm of a shooter. An adjustable extension is secured to the arm brace and extends upwardly therefrom at an angle of about 130 degrees. An inverted U-shaped bag support is secured to the sliding arm of the adjustable extension. The bag support has a pair of pliable arms. A mesh bag is positionable within the inverted U-shaped bag support. The mesh bag has an open upper end that is engagable by the pair of pliable arms for positioning under a gun held by the shooter.

4 Claims, 2 Drawing Sheets

ARM ATTACHABLE DEVICE FOR CATCHING SPENT SHELLS

BACKGROUND OF THE INVENTION

The present invention relates to an arm attachable device for catching spent shells and more particularly pertains to allowing the used shells of a fired gun to be caught for easy disposal.

People who shoot guns, particularly semi-automatic ones;, tend to practice their shooting a significant amount of time. When shooting these guns, the used shells that hold the shot bullets are ejected out of the gun and sprayed around the ground surrounding the shooter. Once the shooting has been completed, the shooter must spend some time gathering the ejected shells for disposal. Sometimes these shells are difficult to find making this search a time-consuming process. There are devices that can attach to the gun itself to catch these ejected shells, but these devices tend to add unwanted weight to the gun. What is needed is a device that will catch these ejected shells without having to be attached to the gun itself.

The present invention attempts to solve the abovementioned problem by providing a device that will catch ejected shells by securing to the shooters arm, and not attached to the gun.

The use of receptacles for containing ejected firearm shells is known in the prior art. More specifically, receptacles for containing ejected firearm shells heretofore devised and utilized for the purpose of containing firearm shells are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,296,565 to Jaffin discloses a device for catching ejected cartridges from a firearm without attaching to the firearm itself; however, it appears to be free standing. U.S. Pat. No. 4,110,927 to Morris discloses a shell caddy attachable to a gun with Velcro tabs. U.S. Pat. No. 4,959,918 to Perez discloses a shell catcher device for attachment to a firearm.

While these devices fulfill their respective, particular objective and requirements, the aforementioned patents do not describe an arm attachable device for catching spent shells for allowing the used shells of a fired gun to be caught for easy disposal.

In this respect, the arm attachable device for catching spent shells according to the present invention substantially departs from the conventional concepts and designs of the prior art, and in doing so provides an apparatus primarily developed for the purpose of allowing the used shells of a fired gun to be caught for easy disposal.

Therefore, it can be appreciated that there exists a continuing need for a new and improved arm attachable device for catching spent shells which can be used for allowing the used shells of a fired gun to be caught for easy disposal. In this regard, the present invention substantially fulfills this need.

SUMMARY OF THE INVENTION

In the view of the foregoing disadvantages inherent in the known types of receptacles for containing ejected firearm shells now present in the prior art, the present invention provides an improved arm attachable device for catching spent shells. As such, the general purpose of the present invention, which will be described subsequently in greater detail, is to provide a new and improved arm attachable device for catching spent shells which has all the advantages of the prior art and none of the disadvantages.

To attain this, the present invention essentially comprises an arm brace adapted for positioning on a forearm of a shooter. The arm brace has a generally rectangular configuration. The arm brace has an inner end and an outer end. The arm brace has an inner surface and an outer surface. The inner surface is padded for positioning on the forearm of the shooter. The arm brace has a pair of securement straps for securing the arm brace to the forearm of the shooter. An adjustable extension is secured to the outer end of the arm brace and extends upwardly therefrom at an angle of about 130 degrees. The adjustable extension is comprised of a fixed arm and a sliding arm. The fixed arm and the sliding arm each have alignable slots therethrough for receiving nuts and bolts to selectively fix the sliding arm with respect to the fixed arm. The sliding arm has a free outer end. An inverted U-shaped bag support is secured to the free outer end of the sliding arm of the adjustable extension. The bag support has a pair of pliable arms. A mesh bag is positionable within the inverted U-shaped bag support. The mesh bag has an open upper end that is engagable by the pair of pliable arms for positioning under a gun held by the shooter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved arm attachable device for catching spent shells which has all the advantages of the prior art receptacles for containing ejected firearm shells and none of the disadvantages.

It is another object of the present invention to provide a new and improved arm attachable device for catching spent shells which may be easily and efficiently manufactured and marketed.

It is a further object of the present invention to provide a new and improved arm attachable device for catching spent shells which is of durable and reliable construction.

An even further object of the present invention is to provide a new and improved arm attachable device for catching spent shells which is susceptible of a low cost of manufacture with regard to both materials and labor, and which accordingly is then susceptible of low prices of sale to the consuming public, thereby making such an arm attachable device for catching spent shells economically available to the buying public.

Even still another object of the present invention is to provide a new and improved arm attachable device for catching spent shells for allowing the used shells of a fired gun to be caught for easy disposal.

Lastly, it is an object of the present invention to provide a new and improved arm attachable device for catching spent shells including an arm brace adapted for positioning on a forearm of a shooter. An adjustable extension is secured to the arm brace and extends upwardly therefrom at an angle of about 130 degrees. An inverted U-shaped bag support is secured to the sliding arm of the adjustable extension. The bag support has a pair of pliable arms. A mesh bag is positionable within the inverted U-shaped bag support. The mesh bag has an open upper end that is engagable by the pair of pliable arms for positioning under a gun held by the shooter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
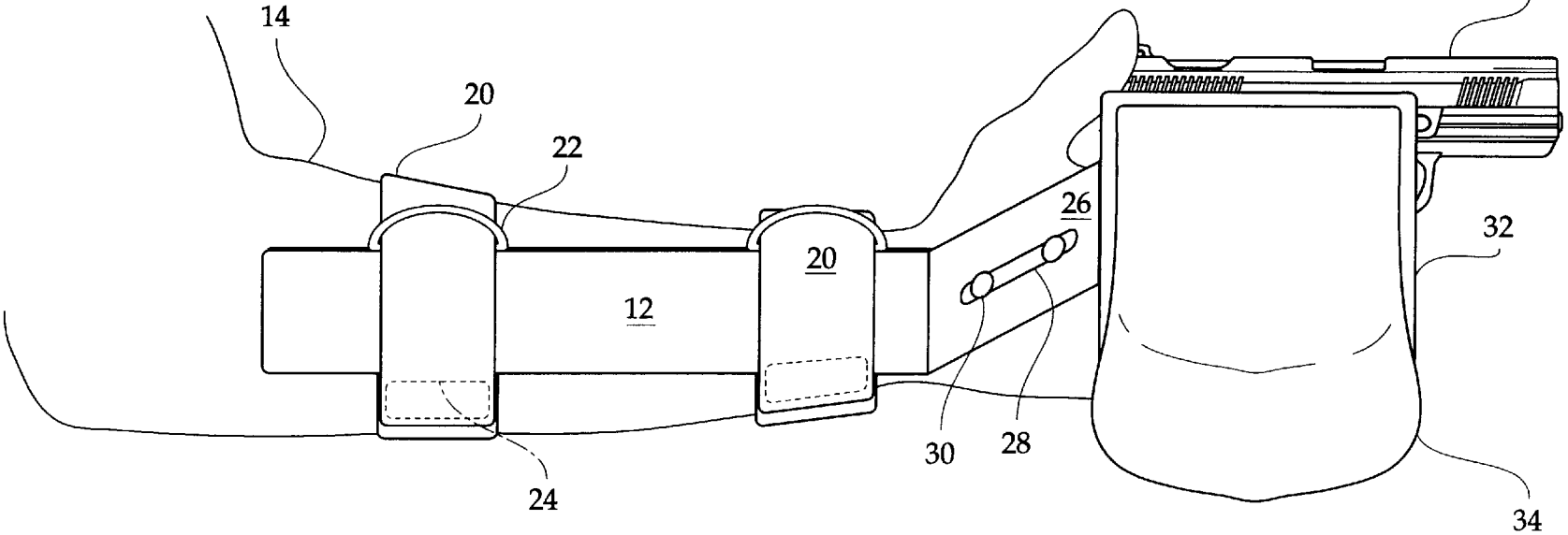
FIG. 1 is a perspective view of the preferred embodiment of the arm attachable device for catching spent shells constructed in accordance with the principles of the present invention.
Figure 2:
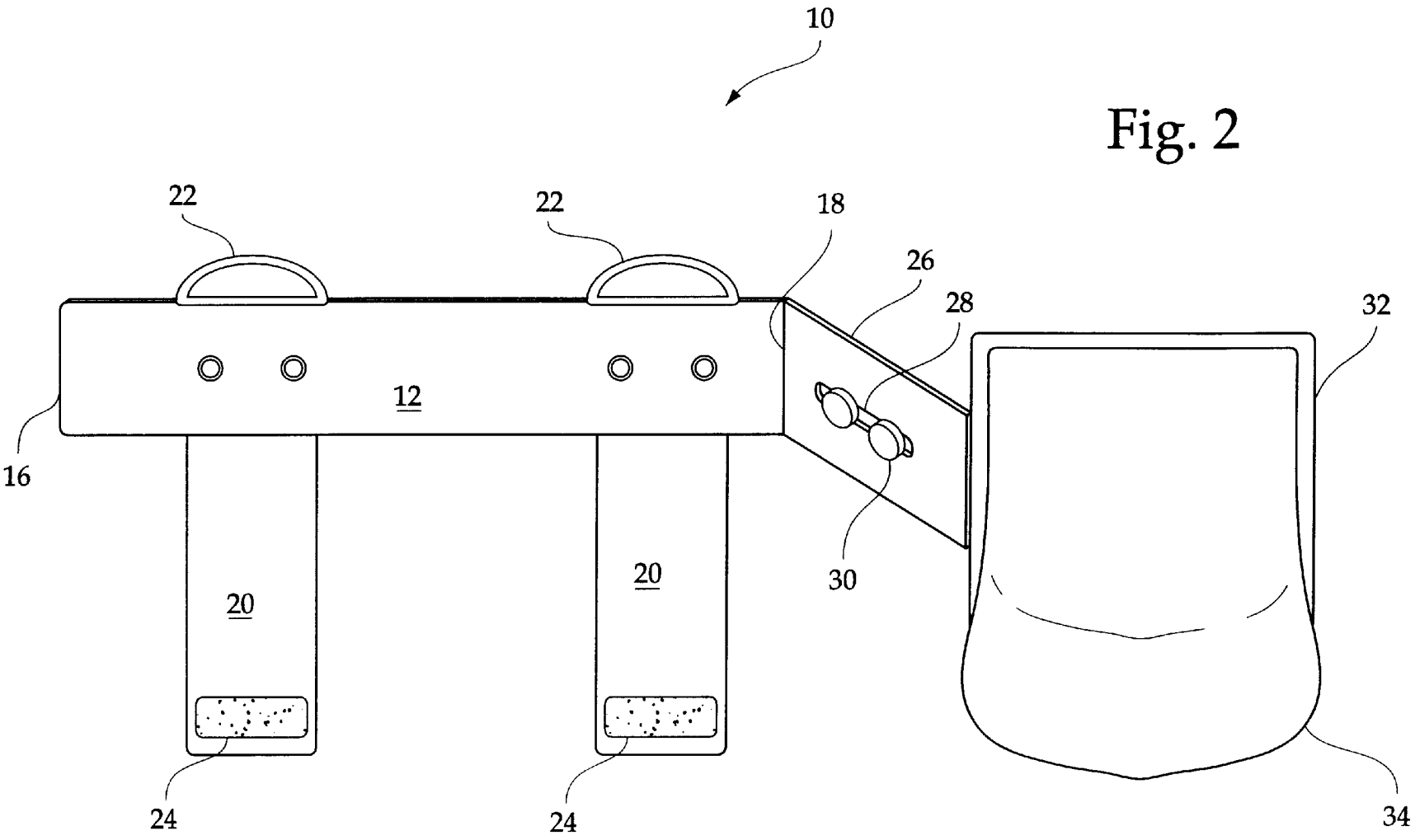
FIG. 2 is an elevated side view of the present invention.

With reference now to the drawings, and in particular, to FIGS. 1 through 2 thereof, the preferred embodiment of the new and improved arm attachable device for catching spent shells embodying the principles and concepts of the present invention and generally designated by the reference number 10 will be described.

Specifically, it will be noted in the various figures that the device relates to an arm attachable device for catching spent shells for allowing the used shells of a fired gun to be caught for easy disposal. In its broadest context, the device consists of an arm brace, an adjustable extension, an inverted U-shaped bag support, and a mesh bag. Such components are individually configured and correlated with respect to each other so as to attain the desired objective.

The arm brace 12 is adapted for positioning on a forearm 14 of a shooter. The arm brace 12 has a generally rectangular configuration. The arm brace 12 has an inner end 16 and an outer end 18. The arm brace 12 has an inner surface and an outer surface. The inner surface is padded for positioning on the forearm of the shooter. The arm brace 12 has a pair of securement straps 20 for securing the arm brace 12 to the forearm 14 of the shooter. The securement straps 20 are provided with D-rings 22 and corresponding hook and loop patches 24 to facilitate securement of the arm brace 12 to the forearm 14. The arm brace 12 is preferably constructed so that it can be comfortably conformed to the forearm of the user. In use, the arm brace 12 will be secured to the outside of the right forearm or to the inside of the left forearm.

The adjustable extension 26 is secured to the outer end 18 of the arm brace 12 and extends upwardly therefrom at an angle of about 130. The adjustable extension 26 is comprised of a fixed arm and a sliding arm. The fixed arm and the sliding arm each have alignable slots 28 therethrough for receiving nuts 30 and bolts to selectively fix the sliding arm with respect to the fixed arm. The sliding arm has a free outer end.

The inverted U-shaped bag support 32 is secured to the free outer end of the sliding arm of the adjustable extension 26. The bag support 32 has a pair of pliable arms.

The mesh bag 34 is positionable within the inverted U-shaped bag support 32. The mesh bag 34 has an open upper end that is engagable by the pair of pliable arms for positioning under a gun 36 held by the shooter. The mesh bag 34 will be positioned under the gun 36 while the shooter is shooting the gun 36. As the gun 36 shoots, the ejected shells will be accumulated within the mesh bag 34 whereupon they can be properly disposed of.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An arm attachable device for catching spent shells for allowing the used shells of a fired gun to be caught for easy disposal comprising, in combination:

an arm brace adapted for positioning on a forearm of a shooter, the arm brace having a generally rectangular configuration, the arm brace having an inner end and an outer end, the arm brace having an inner surface and an outer surface, the inner surface being padded for positioning on the forearm of the shooter, the arm brace having a pair of securement straps for securing the arm brace to the forearm of the shooter;

an adjustable extension secured to the outer end of the arm brace and extending upwardly therefrom at an angle of about 130, the adjustable extension being comprised of a fixed arm and a sliding arm, the fixed arm and the sliding arm each having alignable slots therethrough for receiving nuts and bolts to selectively fix the sliding arm with respect to the fixed arm, the sliding arm having a free outer end;

an inverted U-shaped bag support secured to the free outer end of the sliding arm of the adjustable extension, the bag support having a pair of pliable arms; and a mesh bag positionable within the inverted U-shaped bag support, the mesh bag having an open upper end engagable by the pair of pliable arms for positioning under a gun held by the shooter.

2. An arm attachable device for catching spent shells for allowing the used shells of a fired gun to be caught for easy disposal comprising, in combination:

an arm brace adapted for positioning on a forearm of a shooter;

an adjustable extension secured to the arm brace and extending upwardly therefrom at an angle of about 130 degrees;

an inverted U-shaped bag support secured to the adjustable extension, the bag support having a pair of pliable arms; and a mesh bag positionable within the inverted U-shaped bag support, the mesh bag having an open upper end engagable by the pair of pliable arms for positioning under a gun held by the shooter.

3. The arm attachable device for catching spent shells as set forth in claim 2, wherein the arm brace has a padded inner surface for positioning on the forearm of the shooter.

4. The arm attachable device for catching spent shells as set forth in claim 2, wherein the arm brace has a pair of securement straps for securing the arm brace to the forearm of the shooter.

* * * * *